United States Patent [19]

Medina

[11] 3,981,296

[45] Sept. 21, 1976

[54] SNOW LIQUIFYING APPARATUS

[76] Inventor: Palemon T. Medina, 5420 Lindberg St., Saginaw, Mich. 48603

[22] Filed: Sept. 27, 1973

[21] Appl. No.: 401,354

[52] U.S. Cl. ..... 126/343.5 R; 137/340

[51] Int. Cl.[2] ..... F24H 1/00

[58] Field of Search ..... 137/340; 126/343.5 R, 126/343.5 A; 165/41

[56] References Cited

UNITED STATES PATENTS

| | | | |
|---|---|---|---|
| 207,970 | 9/1878 | Lederer | 126/343.5 R |
| 553,401 | 1/1896 | Von Garnier | 126/343.5 R |
| 663,718 | 12/1900 | Beatty | 126/343.5 R |
| 665,157 | 1/1901 | Zetelle | 126/343.5 R |
| 1,160,205 | 11/1915 | Smith | 126/343.5 R |
| 1,349,853 | 8/1920 | Peden | 126/343.5 R |
| 1,386,137 | 8/1921 | Squire | 126/343.5 R |
| 1,418,630 | 6/1922 | Crouse | 126/343.5 R |
| 3,098,478 | 7/1963 | Philbrook | 126/343.5 R |
| 3,270,741 | 9/1966 | Petlak | 126/343.5 R X |
| 3,304,632 | 2/1967 | Kotlar et al. | 126/343.5 R X |

*Primary Examiner*—Charles J. Myhre
*Assistant Examiner*—Ira S. Lazarus
*Attorney, Agent, or Firm*—John J. Swartz

[57] ABSTRACT

Apparatus for liquifying snow comprising a hopper having a snow receiving chamber, a heat transfer manifold for introducing pressurized heated fluid to the hopper including a portion for heating the lower end of the hopper.

1 Claim, 4 Drawing Figures

SNOW LIQUIFYING APPARATUS

BACKGROUND OF THE INVENTION

This invention relates to apparatus for liquifying snow and more particularly to apparatus which transfers heat, by conduction and convection, to the snow to melt the snow.

It is an object of the present invention to provide new and novel apparatus for liquifying snow.

It is another object of the present invention to provide snow liquifying apparatus including a snow receiving hopper, a duct for introducing heated fluid medium to the hopper after it is used to heat an outside portion of the snow receiving hopper.

It is another object of the present invention to provide snow liquifying apparatus including an open bottom, snow receiving hopper closed by a heat exchange duct which communicates with a source of pressurized, heated fluid medium.

Still another object of the present invention is to provide snow liquifying apparatus including a snow receiving tank closed along the bottom side thereof by a heat transmitting duct which is connected to a source of heated fluid medium and communicates with the chamber to introduce the heated fluid medium in the duct directly to the tank to melt the snow therein.

Yet another object of the present invention is to provide snow liquifying apparatus including a snow receiving hopper having a heat transfer duct at the bottom thereof and an outlet for draining the liquified snow spaced a predetermined distance above the bottom so that a predetermined amount of liquified snow remains at the bottom of the tank to enhance the rapid melting of snow.

Still another object of the present invention is to provide snow melting apparatus of the type described including a duct, adjoining a snow melting chamber, provided with internal baffles which direct the heat toward the chamber to maximize the heat transfer to the snow.

Other objects and advantages of the present invention will become apparent to those of ordinary skill in the art by the following description.

SUMMARY OF THE INVENTION

Apparatus for liquifying snow including a snow receiving tank, and a heating duct for introducing pressurized heated fluid medium to the chamber to heat and melt the snow after it is used to heat an outside bottom portion of the tank.

The present invention may more readily be understood by reference to the accompanying drawings in which.

Figure 1:
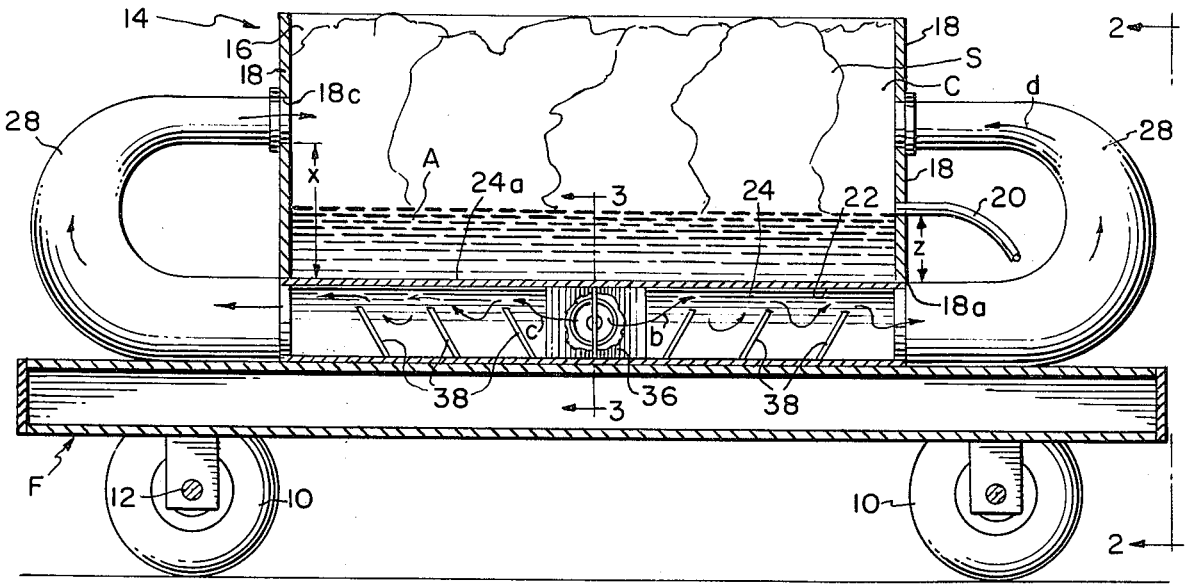
FIG. 1 is a sectional side view taken along the line 1—1 of FIG. 2.
Figure 2:
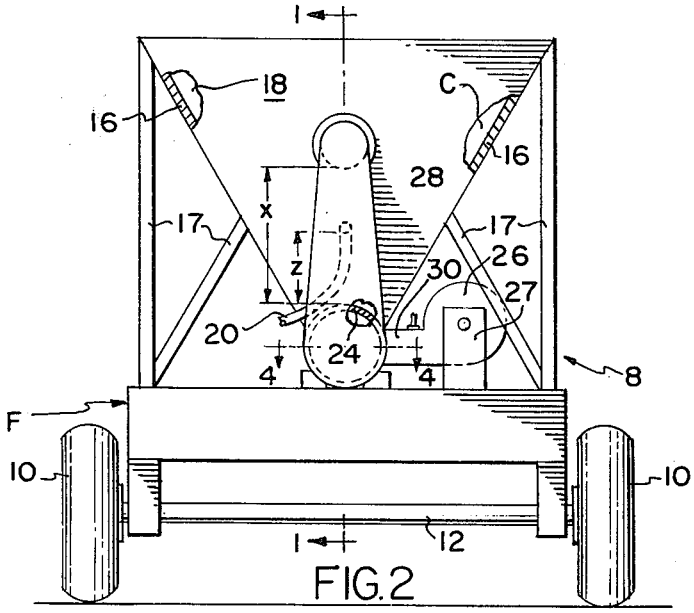
FIG. 2 is an end elevational view, taken along the line 2—2 of FIG. 1.
Figure 4:
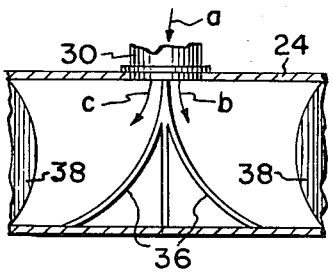
FIG. 4 is an enlarged, top plan view, taken along the line 4—4 of FIG. 2.
Figure 3:
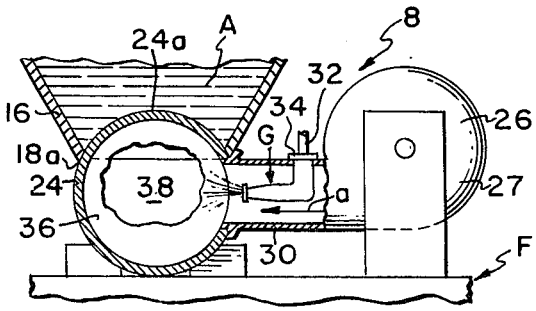
FIG. 3 is an enlarged, sectional end view, taken along the line 3—3 of FIG. 1.

Snow liquifying apparatus constructed according to the present invention is generally designated 8 and is mounted on a portable frame, generally designated F, mounted on road wheels 10 by axles 12. The snow liquifying apparatus 8 includes an open top and bottom, snow receiving tank or hopper, generally designated 14, defining a chamber C for receiving snow S. The tank or hopper 14 includes downwardly converging side walls 16, which are supported on the frame F by upstanding posts 17 and span a pair of end walls 18. The lower portions of the end walls 18 include curvilinear recesses 18*a* receiving a cylindrical, heat transfer manifold or duct 24 which closes the lower opening 22 in the hopper 14. The ends of the duct 24 communicate with 180° loop conduit portions 28 received by apertures 18*c* located in the hopper end walls 18 a predetermined distance *x* above the heat transfer manifold duct 24.

Apparatus for introducing heated, pressurized fluid medium to the duct 24 includes a transverse duct 30 communicating with an air blower or fan 26 which is driven by a gasoline powered, frame supported, engine 27 to force air in the direction of the arrow *a*. Disposed in the transverse duct or tube 30 is a fuel burner, generally designated G, supported by suitable support mounts 34. The fuel burner G, which is connected to a source of fuel via a conduit 32, heats the air being moved by the fan 27 in the direction of the arrow *a*. An air divider plate assembly 36, provided at the junction of the tube 30 and duct 24, divides the heated air moving in the direction of the arrow *a* so that it moves in opposite paths, designated by the arrows *b* and *c*. Disposed along the bottom wall of the duct 24 is a plurality of vertically inclined baffle plates 38 which direct the air moving in the directions of the arrows *b* and *c* upwardly against the upper wall portion 24*a* of the duct 24. The vertical inclination of the baffle plates 38 on one side of the transverse duct 30 is opposite the vertical inclination of the baffle plates 38 on the other side of the duct 24, as illustrated.

A fluid outlet 20 is provided in one of the tank end walls 18 a spaced distance *z* above the top wall 24*a* of the heating duct 24 so that a predetermined amount A of liquified snow remains in the bottom of the tank to provide a heat sink which will be heated by the heat transmitted through the duct wall 24*a* to aid the rapid melting of snow S.

In operation, snow S is deposited in the hopper 14. The fuel burner G is ignited, and the motor 27 is energized to drive the fan 26. Air passing in the direction of the arrow *a* is heated by the burner G and then divides at the baffle 36 to move in opposite directions represented by the arrows *b* and *c*. The vertically inclined baffle plates 38 deflect the heat upwardly against the upper side 24*a* of the cylinder 24 to maintain the upper side 24*a* at a higher temperature than the lower half of the cylinder 24. This assures that maximum heat is transferred to the snow S. The heated air then passes through the 180° loops 28, in the direction of the arrows *d*, directly into the chamber C to impinge directly on the snow S to melt the snow. As the snow melts, it collects on the bottom of the hopper until a level *z* has been reached. The excess liquified snow passes through the overflow drain pipe 20. The fluid A remaining at the bottom of the tank is heated by the duct 24 to provide a heat sink which will rapidly melt the snow as it is deposited in the chamber C.

It is to be understood that the drawings and descriptive matter are in all cases to be interpreted as merely illustrative of the principles of the invention, rather than as limiting the same in any way, since it is contemplated that various changes may be made in the various elements to achieve like results without departing from the spirit of the invention or the scope of the appended claims.

What is claimed is:

1. Apparatus for liquifying snow comprising:

a snow receiving hopper having opposed, downwardly converging sidewalls and opposed end walls spanning said side walls, said side walls and end walls defining a snow receiving chamber for receiving snow to be liquified, said chamber having an open bottom, said end walls each having an opening therethrough;

a heat transfer manifold for introducing snow liquifying, heated fluid into the chamber to liquify snow in the chamber;

said manifold comprising an annular hollow duct having a duct portion underlying said hopper and closing said bottom, said duct also having a pair of 180° loop sections provided with terminal ends communicating with said openings in said end walls to communicate heated fluid to said chamber;

said duct portion underlying said hopper includes upper and lower walls, said upper walls closing said open bottom, and a plurality of vertically inclined baffles mounted on said lower wall terminating a predetermined distance from said upper wall for deflecting said heated medium toward said upper wall to heat and melt snow within said chamber; and liquid outlet means in one of said end walls a predetermined distance above said duct portion for permitting the escape of the liquified snow after a predetermined amount of liquified snow is permitted to collect on said duct portion, said terminal ends extending through said end walls at a level above said liquid outlet means.

* * * * *